US012421658B2

(12) United States Patent
Morgan et al.

(10) Patent No.: US 12,421,658 B2
(45) Date of Patent: Sep. 23, 2025

(54) WIRE ROPE AND AN ASSEMBLY COMPRISING SUCH WIRE ROPE

(71) Applicant: Bridon International Limited, Doncaster (GB)

(72) Inventors: Andrew Morgan, Mayfield East (AU); Hong Hui Sng, Mayfield East (AU); Hendrik Rommel, Sint Michiels (BE)

(73) Assignee: BRIDON INTERNATIONAL LIMITED, Doncaster (GB)

( * ) Notice: Subject to any disclaimer, the term of this patent is extended or adjusted under 35 U.S.C. 154(b) by 295 days.

(21) Appl. No.: 17/913,950

(22) PCT Filed: Apr. 2, 2021

(86) PCT No.: PCT/EP2021/058810
§ 371 (c)(1),
(2) Date: Sep. 23, 2022

(87) PCT Pub. No.: WO2021/204727
PCT Pub. Date: Oct. 14, 2021

(65) Prior Publication Data

US 2023/0119220 A1 Apr. 20, 2023

(30) Foreign Application Priority Data

Apr. 8, 2020 (EP) ..... 20168667

(51) Int. Cl.
*D07B 1/08* (2006.01)
*D07B 1/06* (2006.01)
*D07B 1/16* (2006.01)

(52) U.S. Cl.
CPC ..... *D07B 1/08* (2013.01); *D07B 1/068* (2013.01); *D07B 1/0686* (2013.01); *D07B 1/162* (2013.01);
(Continued)

(58) Field of Classification Search
CPC ..... D07B 1/08; D07B 1/068; D07B 1/0686; D07B 1/162; D07B 1/06; D07B 1/0673;
(Continued)

(56) References Cited

U.S. PATENT DOCUMENTS 4,534,162 A 8/1985 Riggs et al.
4,602,476 A * 7/1986 Riggs ..... D07B 1/14 57/221
(Continued)

FOREIGN PATENT DOCUMENTS

CN 201686880 12/2010
DE 29 49 754 4/1981
(Continued)

OTHER PUBLICATIONS

International Search Report and Written Opinion of the International Searching Authority issued Jul. 9, 2021, in International (PCT) Application No. PCT/EP2021/058810.

*Primary Examiner* — Uyen T Nguyen
(74) *Attorney, Agent, or Firm* — Wenderoth, Lind & Ponack, L.L.P.

(57) ABSTRACT

A wire rope for face shovels or draglines, comprising: a core, said core is made from a plurality of core strands a plurality of outer strands laid on said core, a plurality of separator strands located in the interstices between said core strands and said outer strands, a plastic jacket around said plurality of outer strands, said plurality of separator strands and said core strands, wherein said plurality of separator strands extend from said core strands and in-between each pair of said plurality of outer strands so as to produce and maintain gaps between said pair of said plurality of outer strands; wherein said core strands are compacted, and the gap between said core strands is less than 0.4% of the diameter of the core strand.

3 Claims, 1 Drawing Sheet

(52) U.S. Cl.
CPC ..... *D07B 2201/102* (2013.01); *D07B 2201/2009* (2013.01); *D07B 2201/2019* (2013.01); *D07B 2201/2023* (2013.01); *D07B 2201/2039* (2013.01); *D07B 2201/204* (2013.01); *D07B 2201/2041* (2013.01); *D07B 2201/2059* (2013.01); *D07B 2201/2066* (2013.01); *D07B 2201/2072* (2013.01); *D07B 2201/2092* (2013.01); *D07B 2205/00* (2013.01); *D07B 2401/2075* (2013.01); *D07B 2501/2015* (2013.01)

(58) Field of Classification Search
CPC ..... D07B 1/16; D07B 5/005; D07B 5/007; D07B 2201/102; D07B 2201/2009; D07B 2201/2019; D07B 2201/2023; D07B 2201/2039; D07B 2201/204; D07B 2201/2041; D07B 2201/2059; D07B 2201/2066; D07B 2201/2072; D07B 2201/2092; D07B 2401/2075; D07B 2501/2015
See application file for complete search history.

(56) References Cited

U.S. PATENT DOCUMENTS

| | | | | |
|---|---|---|---|---|
| 5,386,683 | A | 2/1995 | Misrachi | |
| 7,389,633 | B2 | 6/2008 | Misrachi | |
| 2008/0078157 | A1* | 4/2008 | Dold | D07B 1/22 57/212 |
| 2014/0374195 | A1* | 12/2014 | Deconinck | B66B 7/06 57/221 |
| 2015/0247285 | A1* | 9/2015 | Amils | D07B 1/005 57/17 |
| 2015/0315742 | A1* | 11/2015 | Lauer | D07B 1/165 57/7 |
| 2017/0370046 | A1* | 12/2017 | Rommel | D07B 1/165 |
| 2020/0115851 | A1* | 4/2020 | Vanreyten | F16G 1/12 |

FOREIGN PATENT DOCUMENTS

| | | |
|---|---|---|
| DE | 29 49 755 | 6/1981 |
| DE | 32 14 871 | 11/1982 |
| WO | 2016/120237 | 8/2016 |

* cited by examiner

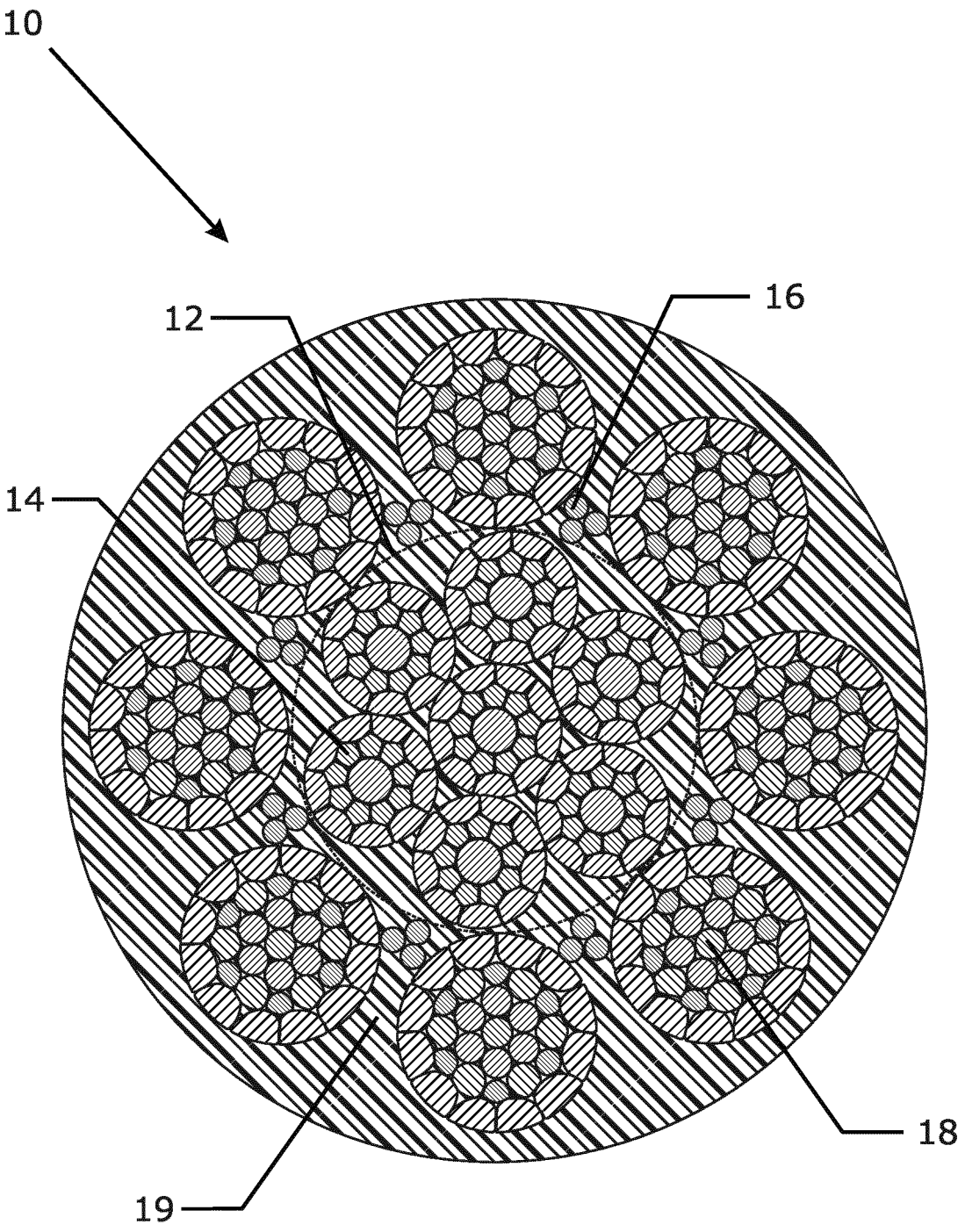
10
12
16
14
18
19

WIRE ROPE AND AN ASSEMBLY COMPRISING SUCH WIRE ROPE

TECHNICAL FIELD

The present invention relates to a wire rope, in particular to a high performance wire rope for face shovels and draglines, and an assembly of a drum and such a wire rope.

BACKGROUND ART

Plastic impregnated ropes are recommended for severe mining applications where the rope is exposed to high levels of wear and fatigue and particularly where there is a possibility that abrasive dust, dirt or corrosive material might penetrate the rope during normal operation.

The steel wire rope is impregnated by a special process whereby the individual strand gaps within the rope are filled with a sealing thermoplastic material forming a protective layer between the individual strands and around the core of the rope.

Plastic impregnation protects the rope from dirt, dust penetration, other corrosive materials, and also from internal wear from friction between the strands. Therefore, the life of the rope is greatly prolonged. In addition, plastic impregnated wire rope has several advantages. It has much lower stretch than standard wire rope, because the thermo-plastic fills in the voids in the rope, thus reducing it's ability to pull down. This is hugely beneficial for ropes which experience high levels of torque, as this process prevents the rope from twisting apart. Another benefit is the fatigue properties: the plastic filling reduces wire contact bending stresses and so reduces the stress concentration at the contact point between the strands and the core. Impregnated plastic results in a more stable rope, as the components are locked into position by the plastic. The resulting rope is much more resistant to shock loading and greatly increases the working life of the rope.

Plastic impregnated wire rope is useful in more extreme conditions (e.g. dirty, dusty or chemical environments). It is also often used in the coal or ore industry, piling operations and shovel cranes, as well as applications with very high wear levels.

Conventional plastic impregnation of ropes is not a very controlled process since it is difficult to control how the rope is impregnated. Usually, the plastic just fills randomly the voids of the interior of the rope. During this process, it is difficult to avoid situations whereby two or more outer rope strands contact each other or the outer rope strands contact the outer strands of the core when the rope is flexed during use. These contact points become steel-to-steel abrasion points during the operation of the ropes, leading to the eventual failure of the rope.

Maintaining the strand-to-strand and strand-to-core separation in a plastic impregnated rope is quite difficult. One such method is disclosed in U.S. Pat. Nos. 5,386,683 and 7,389,633 where specially designed plastic or fibrous rods are provided as wormings to prevent contact between the outer strands. Alternatively, U.S. Pat. No. 4,534,162 and international patent application WO2016/120237 disclose the application of metal separation strands to keep the distance between outer strands.

On the other hand, during delivery or application of a wire rope, the wire rope is wound/bent onto a drum. Poor support of the wire rope on the drum can cause bellying out of the wire rope and internal shearing of the plastic. This becomes particularly challenging for critical applications, e.g. face shovels or draglines, where diameter ratio of the wire rope drum to wire rope is very unfavourable. There is a need to improve the stability and lifetime of the rope.

DISCLOSURE OF INVENTION

It s an object of the present invention to provide a wire rope having a high fatigue life and wear resistance.

It is another object of the present invention to provide a wire rope having a stable plastic jacket and prolonged lifetime.

It is yet an object of the present invention to provide a wire rope suitable for severe fretting operations and critical applications, e.g. for face shovels and draglines.

According to the first aspect of the present invention, there is provided a wire rope for face shovels and draglines. The wire rope comprises a core, wherein said core is made from a plurality of core strands, a plurality of outer strands laid on said core, a plurality of separator strands located in the interstices between said core strands and said outer strands, a plastic jacket around said plurality of outer strands, said plurality of separator strands and said core strands. The plurality of separator strands extend from said core strands and in-between each pair of said plurality of outer strands so as to produce and maintain gaps between said pair of said plurality of outer strands. The core strands are compacted, and the gap between said core strands s less than 0.4% of the diameter of the core strand.

In the content of the present invention, "separator strands" refer to strands used as wormings, spacers or separator means for maintaining a gap between each pair of the outer strands. Separator strands or wormings are distinguished from fillers in the prior art. The location and function of wormings are different from fillers. Separator strands or wormings are sitting in-between each pair of the outer strands while fillers would fill in voids in-between two adjacent layers of strands. Separator strands or wormings are used to maintain the gaps between each pair of strands while fillers are usually used to fill in the gaps in the ropes to make the rope more circular. Separator strands or wormings have the same lay length of the layer that they are associated with while fillers have the same lay length of the filaments they touch.

In the content of the present invention, 'strands' can also be interpreted as 'cords'. It is typically made up of several single filaments. 'Single filament' in this context is a wire of a single, uninterrupted length. Herein, individual wires having an uninterrupted length need not be the same. The filaments or wires are twisted with an intended lay length to form a strand or a cord.

The plurality of outer strands and the plurality of separator strands can be made from metals or metal alloys, such as copper, aluminum or steel. Preferably, the hardness of said plurality of separator strands is lower than that of said plurality of outer strands of the wire rope. Preferably, said core, said plurality of outer strands, and said plurality of separator strands are all made from steel. As an example, said core and said plurality of outer strands are made from high carbon steel having a carbon content in the range of 0.5 to 1.5 weight percent and said plurality of separator strands are made from low carbon steel having a carbon content in the range of 0.2-0.5 weight percent. For example, a high carbon steel can have a carbon content ranging between 0.5 wt % and 0.8 wt %, a manganese content from 0.3 wt % to 0.80 wt %, a silicon content ranging from 0.10 wt % to 0.50 wt %, a maximum sulphur content of 0.05 wt %, a maximum phosphorus content of 0.05 wt %, the remainder being iron and possible traces of copper, chromium, nickel, vanadium, molybdenum or boron. Alternatively, the wire of outer strands may also have the following composition: a carbon content ranging between 0.8 wt % to 1.0 wt %, a manganese content from 0.5 wt % to 0.8 wt %, a silicon content ranging from 0.1 wt % to 5.0 wt %, a chromium content from 0.1 wt % to 0.5 wt %, a vanadium content from 0.02 wt % to 0.2 wt %, the remainder being iron and possible traces. As an example, the wires of the outer strand have a composition of 0.84 wt % carbon, 0.67 wt % manganese, 0.23 wt % silicon, 0.24 wt % chromium, 0.075 wt % vanadium, the remainder being iron and possible traces. A low carbon steel composition is a steel composition where—possibly with exception for silicon and manganese—all the elements have a content of less than 0.50% by weight, e.g. less than 0.20% by weight, e.g. less than 0.10% by weight. E.g. silicon is present in amounts of maximum 1.0% by weight, e.g. maximum 0.50% by weight, e.g. 0.30% by weight or 0.15% by weight. E.g. manganese is present in amount of maximum 2.0% by weight, e.g. maximum 1.0% by weight, e.g. 0.50% weight or 0.30% by weight. For an example of low carbon separator strands, the carbon content ranges up to 0.5% by weight, e.g. ranging up to 0.06% by weight. The minimum carbon content can be about 0.02% by weight.

As an alternative solution, said core and said plurality of outer strands are made from steels (either high carbon steel or low carbon steel), and said plurality of separator strands are made from copper. The use of copper as the material for separator strands, or low carbon steel as the material for separator strands while high carbon steel as the material for the outer strands has the advantage that these separator strands can be the "weak" parts when fretting occurs since they are relatively soft. In this way, the outer strands are not suffering of huge fretting due to the metal separator strands.

According to the present invention, the separator means between the outer strands of the wire rope are in the form of strands allowing that the plastic goes around the separator strands and so the plastic is not stopped by the separators or wormings. The plastic jacket can penetrate into said plurality of separator strands. This is advantageous over fiber-wormings as there is no or no sufficient space for fiber wormings with respect to plastic penetration.

The plastic jacket on said wire rope can be selected from polyamide (PA), polyethylene (PE), polyethylene terephthalate (PET), polypropylene (PP), polyurethane (PU), polysulfone (PES), ethylene tetrafluoroethylene (ETFE). The plastic jacket is formed to extend over the periphery of the wire rope by a thickness preferably in the range of 1.0 mm to 2.0 mm. The plastic jacket can be made by any suitable method, preferably by extrusion.

The application of separator strands, on the one hand provides better fretting resistance over plastic or fibrous rod separators, and on the other hand assures that there is a minimum gap between the outer strands facilitating the plastic to flow and pass the separator strands during jacketing in order to have full plastic penetration. Consequently, the performance of the rope can be improved as a benefit of full penetration of plastic jacket.

On the other hand, strands can create a stress concentration at the strand-to-strand contact point. This will shear the plastic of the wire rope. The separator strands are helpful to provide resistance to plastic peel off, but separator strands alone are not sufficient. It has been found that non-compacted strand can create a significant stress concentration at the strand-to-strand contact point and this will shear the plastic much earlier than compacted strand. According to the present invention, in order to improve resistance to plastic peel off, the rope outer strands are compacted. This provides a much smoother surface at the strand to strand contact point, which is the origin of the failure point with regard to plastic failure. As an example, the rope strand according to the invention has a central wire, a first layer of wires around the central wire and a second or more layer of wires around the first layer of wires.

The core can be made as compression resistant as possible. To do this, the gaps in the core stands are set to zero in the rope design and the strands are compacted to resist further pulling down in service. However, it shall be noted that due to reasons like the helix angle of the strand is not perfectly round or the deviation of the radius of the strand along its length, the gaps between the strands of rope core will be not always equal to zero but can be slightly larger than zero. The gap between the strands of rope core is less than 0.4% of the diameter of the core strand, e.g. less than 0.2% of the diameter of the core strand, preferably less than 0.1% of the diameter of the core strand, and more preferably less than 0.05% of the diameter of the core strand and most preferably almost zero. This is not common as most rope designers leave some gap for the core strands to move and not fret against each other. It has been found that the plastic impregnation around the strands in the core keeps them separated enough that there are no wire breaks or internal fretting when the core strand gap is set at zero. These features make the rope resistant to compression and this technical solution achieves a very positive improvement in the integrity of the plastic jacket.

According to the invention, the lay length of said core is preferably shorter than the lay length of said outer stands. When a wire rope is loaded, it stretches. For a shovel or dragline rope loaded to 30-40% of it's breaking force, the amount of stretch is approximately 2%. Within the wire rope there are three main elements: the core, which is made at a shorter lay length to the outer strands, the spacer strands which are laid in the gap under the main strands at the same lay length as the outer strands and the main outer strands. The stretch is made up of elongation of the individual wires, extension of the lay length and pulling down of the rope which reduces the helix diameter and extends the rope length. The shorter lay length of the core allows the stretch in the wire to remain similar to the stretch in the wire in the outer strands.

The gap between outer stands can be in a range from 4% to 8% of the outer strand diameter. Due to the nature of the bending and loading of the rope the strand gap must be sufficient to allow the strand gap to contract under load but not let the strands touch. If the strands touch, the plastic membrane between the strands will be severed and the outer jacket will peel off.

The plurality of outer strands and the plurality of separator strands may both have a near circular cross-section. Preferably, the plurality of outer strands and the plurality of the separator strands are also the same. The ratio of the diameter of said plurality of outer strands to the diameter of said plurality of separator strands is in the range of 3 to 10, e.g. 6 to 10, and e.g. 5 to 8. This ratio plays the role to control the magnitude of the gaps between the outer strands and the filling ratio of metals in the wire rope.

As an example, the diameter of said plurality of outer strands is in the range of 2 to 40 mm, e.g. in the range of 10 to 30 mm or in the range of 15 to 25 mm. The diameter of said wire rope is in the range of 5 to 200 mm, e.g. in the range of 10 to 100 mm or in the range of 30 to 50 mm. The metal or steel reinforced separator strands can be especially used for big diameter ropes where the gap between the separator strands and the ropes are rather big (e.g. about 1 mm, about 2 mm or even bigger) and therefore allow the plastic going easily around the separators. For medium-small diameter ropes, this will be very important when jacketing with full penetration is needed. Minimum gaps are required for the good flow of plastics during jacketing. If the gaps are too small, very high pressure is required. By using separator strands, the gaps between the outer strands are maintained and still plastic can pass by. This is an important advantage even for ropes with a coated core strand.

Preferably, the elastic modulus of said separator strands is lower than said outer strands, and the elastic limit of said separator strands is higher than said outer strands. The separator strands are laid to the same lay length to the outer strands have less capability to deal with the stretch in the rope as their helix diameter is less. They still see the same amount of stretch and so more stretch is transferred into elongation of the wires. If the rope elongation under shock load is too high the wire in the separator strand can yield and permanently stretch. This can cause separator strands to migrate out of the wire rope. The elastic limit is the stress value beyond which the material no longer behaves elastically but becomes permanently deformed. Preferably, the elastic limit of the separator strand wire is at least 10% higher than the wire in the core and outer rope strands, based on the dimensions of the rope. More preferably, the separator strand wire has an elastic limit 30% higher than the wire in the core and outer rope strands.

According to the invention, said outer stand preferably has Warrington Seale construction. Referring to Warrington type, the number of wires of each layer is shown as 1+n+(n+n), and there are two sizes of wires for the $2^{nd}$ last outer layers, one being large and the other being small. The number of wires of the $2^{nd}$ last outer layer is double that of the inner layer and through a combination of the large & small wires, the spaces between the wires is kept small. While referring to Seale type, the number of wires of each layer is shown as 1+n+n and the number of wires of the inner and outer layers is the same. The wires of the outer layer fit completely into the grooves of the inner layer wires. The outer layer wires of this Seale type rope is thicker when compared to other parallel lays and so it is superior, particular in its wear resistance. Warrington Seale construction is a combination between the Warrington type and the Seale type where the $2^{nd}$ last outer layers, one being large and the other being small and the number of wires of the $2^{nd}$ last outer layer is double that of the inner, and is extremely superior in its fatigue resistance nature. It also abounds in flexibility and is superior in its wear resistance nature and so has a wide range of uses. As examples, said outer stand has a 36 wire construction (1,7,7+7,14), a 31 wire construction (1, 6, 6+6, 12) or a 49 wire construction (1, 8, 8, 8+8, 16).

When heavily loaded, e.g. in surface mining application, Warrington Seale construction is superior than other constructions, e.g. compared with Seale construction. The strands having seale filler construction approach the yield point when heavily loaded. When there is a large discrepancy in wire diameter, as in the seale filler construction (disclosed in U.S. Pat. No. 4,534,162), the small filler wires tend to yield and stretch. They then pop to the outside of the strand and do not contribute to the stretch of the rope.

In general, the more strands in a rope the more flexibility. The less strands the more robust the rope is. As a preferred example, said rope has eight outer stands. More preferably, said outer stands are also compacted.

According to a second aspect of the present invention, it is provided an assembly of a drum and a wire rope for face shovels or draglines. In such an assembly, the wire rope as described above according to the present invention is bent or wound around the drum. When the drum has a diameter of D, the wire rope has a diameter of d, it satisfies that the D/d ratio is between 20:1 to 40:1, e.g. between 20:1 to 30:1. As an example, a shovel rope drum has a diameter of 1700 mm and the corresponding shovel rope bent thereon has a diameter of 72 mm. This gives a D/d ratio of 24. The wire rope for face shovels or draglines is subject to heavy shock loads. The working stress in the wire rope can be up to 35% of Minimum Break Force. Moreover, the supporting grooves on the drum can be very shallow. These conditions lead to specific failure modes that are not observed in other rope applications. These are: heavy internal contact stresses in the rope; poor support of the rope on the drum causing bellying out of the rope and internal shearing of the plastic; heavy compressive stress between the rope and the drum cause plastic to deform. The wire rope according to the present invention has a long lifetime under above conditions, although the plastic jacket around said plurality of outer strands, said plurality of separator strands and said core strands can be deformed. The assembly of the drum and the wire rope present good performance in applications for face shovels or draglines.

BRIEF DESCRIPTION OF FIGURES IN THE DRAWINGS

The invention will be better understood with reference to the detailed description when considered in conjunction with the non-limiting examples and the accompanying drawings, in which:

FIG. 1 schematically shows an example of the wire rope according to the present invention.

MODE(S) FOR CARRYING OUT THE INVENTION

A construction of the wire rope of the present invention is illustrated in FIG. 1. The wire rope has a diameter of 72 mm and a configuration of EP8xK36WS+IWRC (1,6,8+8). Herewith, EP refers to the wire rope covered with a polymer. The wire rope has 8 compacted outer strands having 36 wires in combined parallel lay, indicated by 8xK36WS. The core is an independent wire rope (IWRC). The entire rope construction is shown as 1+6+(8+8) and there are two kinds of cords for the outer layers, one being large and the other being small, i.e. it is a parallel lay strand construction having an outer layer of alternately large cords and small cords.

As shown in FIG. 1, the wire rope 10 has an independent wire rope core (IWRC) 12. The independent rope core 12 is a steel wire rope made from seven strands 14 having same rope construction. Each of the core strands 14 is compacted. In addition, the gap between said core strands is less than 0.03 radius of the core strand but in rope design, the gap between the core strands 14 is set to zero.

There are placed 8 separator strands 16 and 8 compacted outer strands 18, which are made from steel, laid on the independent rope core 12. The separator strands 16 are provided in-between the compacted outer strands 18 so as to create a gap between each pair of compacted outer strands 18.

The wire rope 10 is enclosed with a plastic jacket 19. Preferably, the plastic jacket 19 is made of polypropylene and more preferably produced by extrusion. The plastic jacket 19 is extruded to extend over the periphery of the wire rope by a thickness in the range of 1 mm to 2 mm, i.e. 1.50 mm.

Such a wire rope can be wound on a rope drum having a diameter as low as 1700 mm. The wire rope used for face shovels or draglines approves a considerably prolonged lifetime.

The invention claimed is:

1. An assembly of comprising a drum and a steel wire rope for face shovels or draglines, wherein the steel wire rope is wound around the drum, wherein the drum has a diameter of D, the steel wire rope has a diameter of d, and the D/d ratio is between 20:1 to 40:1, and wherein the steel wire rope comprises:

a core, the core being made from a plurality of core strands, a plurality of outer strands laid on the core, a plurality of separator strands located in interstices between the core strands and the outer strands, and a plastic jacket around the plurality of outer strands, the plurality of separator strands, and the core strands, wherein said plurality of separator strands extends from the core strands and is in between each pair of the plurality of outer strands so as to produce and maintain gaps between the pair of said plurality of outer strands, wherein the core strands are compacted, wherein a gap between each of the core strands is less than 0.4% of the diameter of each of the core strands, wherein the core, the plurality of outer strands, and the plurality of separator strands are made from steel, wherein each of the core strands and/or each of the outer strands has a central wire, a first layer of wires around the central wire, and a second or more layer of wires around the first layer of wires, wherein a gap between each of the outer strands is in a range from 4% to 8% of the diameter of each of the outer strands, wherein a lay length of the core is shorter than a lay length of the outer strands, wherein the elastic modulus of the separator strands is lower than the elastic modulus of the outer strands, and the elastic limit of the separator strands is higher than the elastic limit of the outer strands, wherein the elastic limit of wires forming the separator strands is at least 10% higher than the elastic limit of wires forming the core and outer strands, wherein the rope has eight outer strands, wherein the outer strands are compacted, wherein the outer strands have a Warrington Seale construction, and wherein the outer strands have a 36 wire construction (1,7,7+7, 14), a 31 wire construction (1, 6, 6+6, 12) or a 49 wire construction (1, 8, 8, 8+8, 16).

2. The assembly of claim 1, wherein the D/d ratio is 24:1.

3. The assembly of claim 1, wherein the plastic jacket around the plurality of outer strands, the plurality of separator strands, and the core strands is deformed.

* * * * *